US006290339B1

(12) United States Patent
Furlani et al.

(10) Patent No.: US 6,290,339 B1
(45) Date of Patent: Sep. 18, 2001

(54) METHOD OF DIRECTING FLUID BETWEEN A RESERVOIR AND A MICRO-ORIFICE MANIFOLD

(75) Inventors: Edward P. Furlani, Lancaster; Syamal K. Ghosh; Dilip K. Chatterjee, both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/121,194

(22) Filed: Jul. 22, 1998

(51) Int. Cl.[7] ..... B41J 2/14; B41J 2/045

(52) U.S. Cl. ..... 347/68; 347/48; 347/70; 347/71

(58) Field of Search ..... 347/20, 44, 54, 347/68–72, 48

(56) References Cited

U.S. PATENT DOCUMENTS 5,802,686 * 9/1998 Shimada et al. ..... 347/71

* cited by examiner

*Primary Examiner*—John Barlow
*Assistant Examiner*—An H. Do
(74) *Attorney, Agent, or Firm*—Clyde E. Bailey, Sr.

(57) ABSTRACT

A method of directing fluid between a reservoir and a micro-orifice manifold includes the step of providing a piezoelectric actuating element operably associated with independent fluid containment chambers of said manifold. The piezoelectric actuating element is activated by applying a voltage to electrodes which produces fluid flow by changing its geometry inside the reservoir in response to an applied voltage.

5 Claims, 7 Drawing Sheets

METHOD OF DIRECTING FLUID BETWEEN A RESERVOIR AND A MICRO-ORIFICE MANIFOLD

CROSS REFERENCE TO RELATED APPLICATIONS

Reference is made to commonly assigned U.S. Pat. No. 5,900,274, issued may 04, 1999, entitled "Controlled Composition and Crystallographic Changes in Forming Functionally Gradient Piezoelectric Transducers" by Chatterjee et al, U.S. patent application Ser. No. 09/071,486 filed May 1, 1998, entitled "Functionally Gradient Piezoelectric Transducers" by Furlani et al, now abandoned, and U.S. Pat. No. 6,013,311, issued Jan. 11, 2000 entitled "Using Morphological Changes to Make Piezoelectric Transducers", by Chatterjee et al, the disclosures of which are incorporated herein by reference.

FIELD OF THE INVENTION

The invention relates generally to the field of fluid flow and, more particularly, to a method of directing fluid flow through a micro-orifice manifold using a functionally gradient piezoelectric element.

BACKGROUND OF THE INVENTION

Piezoelectric ink jet elements are used in a wide range of micro-fluidic printing devices. Conventional ink jet elements utilize piezoelectric transducers that comprise one or more uniformly polarized piezoelectric elements with attached surface electrodes. The three most common transducer configurations are multilayer ceramic, mono-morph or bi-morphs, and flex-tensional composite transducers. To activate a transducer, a voltage is applied across its electrodes thereby creating an electric field throughout the piezoelectric elements. This field induces a change in the geometry of the piezoelectric elements resulting in elongation, contraction, shear or combinations thereof. The induced geometric distortion of the elements can be used to implement motion or perform work. In particular, piezoelectric bimorph transducers that produce a bending motion, are commonly used in micro-pumping devices. However, a drawback of the conventional piezoelectric bimorph transducer is that two bonded piezoelectric elements are needed to implement the bending. These bimorph transducers are typically difficult and costly to manufacture for micro-pumping applications (in this application, the word micro means that the dimensions of the element range from 100 microns to 10 mm). Also, when multiple bonded elements are used, stress induced in the elements due to their constrained motion can damage or fracture an element due to abrupt changes in material properties and strain at material interfaces.

Therefore, a need persists for an ink jet head that overcomes the aforementioned problems associated with conventional ink jet apparatus.

SUMMARY OF THE INVENTION

It is, therefore, an object of the present invention to provide a method of directing fluid flow through a micro-orifice manifold actuated by a functionally gradient piezoelectric actuating element.

It is a feature of the invention that a functionally gradient piezoelectric transducer is provided integral to the micro-orifice manifold that actuates the flow of fluid between a fluid containment chamber in the manifold and a reservoir.

To accomplish these and other objects of the invention, there is provided a method of directing fluid flow between a reservoir and any one of a plurality of independent fluid containment chambers of the micro-fluidic manifold. The method of the invention involves the steps of providing a piezoelectric actuator element (described in details below) in structural relations with each one of the fluid containment chambers. Further included is the step of providing a source of power operably associated with each one of a plurality of first electrodes and a second electrode of the piezoelectric transducer for enabling fluid flow through any one of the plurality of fluid containment chambers of the micro-orifice manifold. The piezoelectric transducer is then actuated in a manner fully described herein for pumping fluid between any one of independent fluid containment chambers of the manifold and the reservoir.

BRIEF DESCRIPTION OF THE DRAWINGS

The above and objects, features and advantages of the present invention will become apparent when taken in conjunction with the following description and drawings wherein identical reference numerals have been used, where possible, to designate identical features that are common to the figures, and wherein.

DETAILED DESCRIPTION OF THE INVENTION

Figure 1:
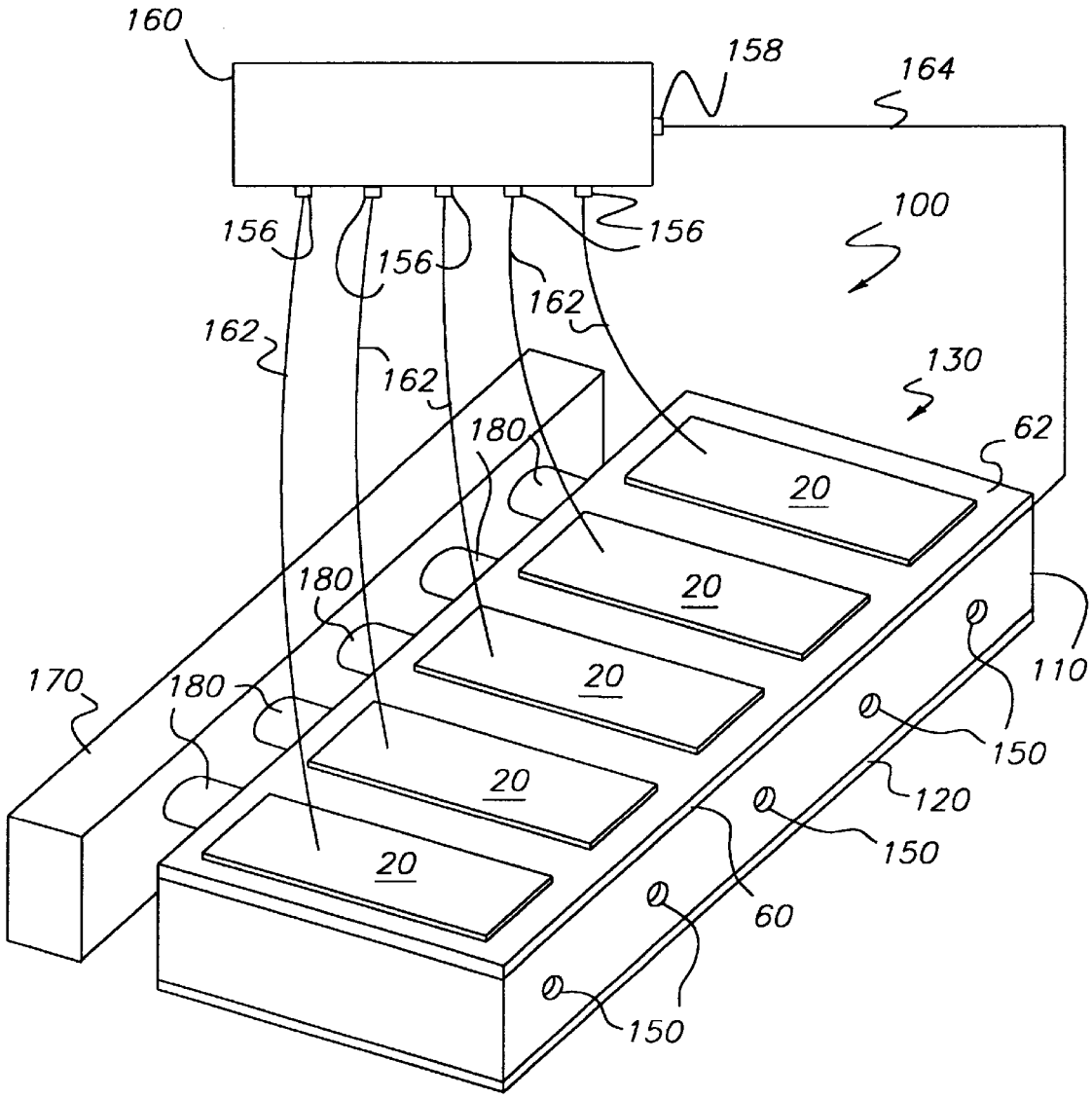
FIG. 1 is a perspective view of the ink jet head of the invention.
Figure 2:
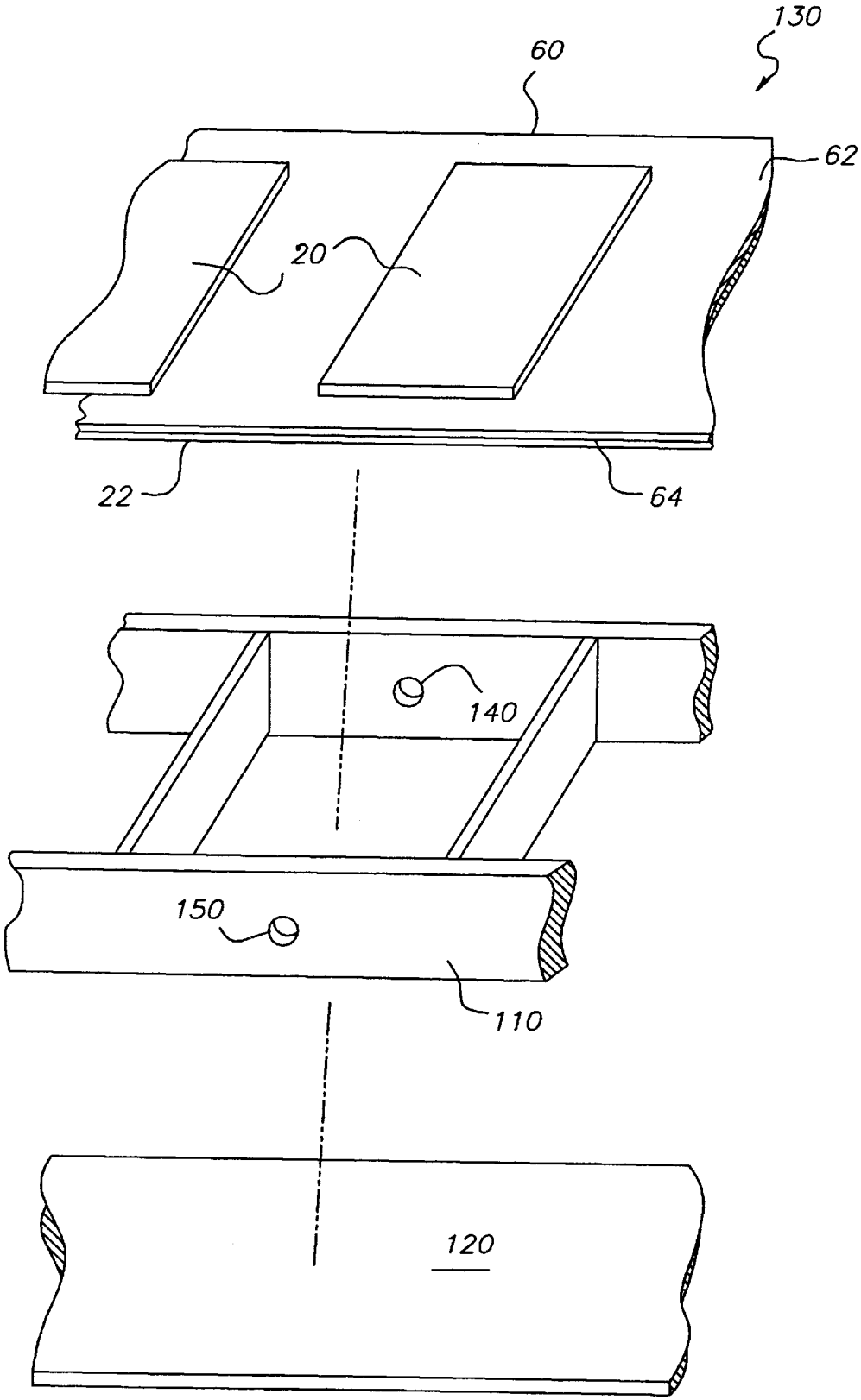
FIG. 2 is an exploded view of a portion of the ink jet head of the invention.
Figure 9:
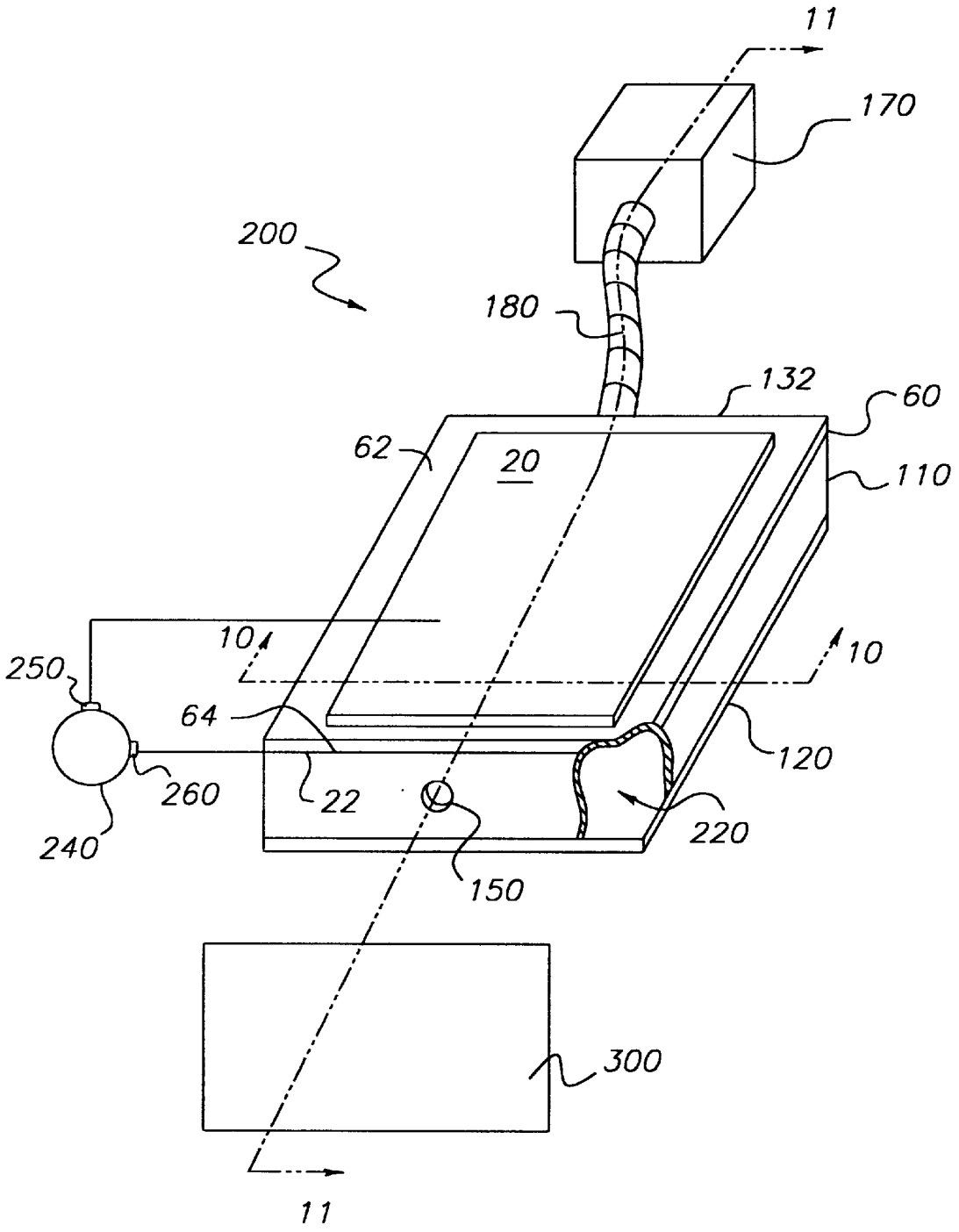
FIG. 9 is a perspective view of a single ink jet element of the invention with a partial cut away section illustrating the internal ink storage chamber.

Turning now to the drawings, and particularly to FIGS. 1, 2, and 9, a micro-orifice manifold, such as an ink jet head 100, of the present invention is illustrated. As depicted in FIGS. 1 and 2, the manifold, or alternately ink jet head 100, comprises a body 110, a base 120, and a piezoelectric actuating element 130. The body 110 has a plurality of separated compartments each having an inlet orifice 140 and outlet orifice 150. The base 120 and piezoelectric actuating element 130 are fixedly attached to the body 110. Together, the base 120, element 130 and body 110 form a contiguous array of independent manifold elements or for instance, ink jet elements 200 (see FIG. 9), each of which having fluid containment chamber 220 with an inlet orifice 140 (shown clearly in FIG. 2) and outlet orifice 150 and a piezoelectric actuator 132. The piezoelectric actuating element 130 comprises a slab 60 of piezoelectric material with first and second opposing surfaces 62 and 64. A plurality of first surface electrodes 20 are mounted on the first surface 62 and a second surface electrode 22 extends substantially lengthwise along the second surface 64. Each one of the plurality of first electrodes 20 is operably associated to each one of the plurality of fluid containment chambers 220 (shown clearly in FIG. 9). A power source 160 has a plurality of first terminals 156 each one of which being connected to one of the plurality of first surface electrodes 20 via wires 162. A second terminal 158 is electrically connected to the second surface electrode 22 via wire 164. The power source 160 can impart a voltage of a specified polarity and magnitude to any one of the plurality of first electrodes 20, and a different such voltage can be simultaneously applied to any number of the plurality of first electrodes 20. In addition, the power source 160 can simultaneously apply a different voltage to the second electrode 22 of piezoelectric actuating element 130. An ink reservoir 170 is connected via fluid conduits 180 to inlet orifices 140 for supplying ink to the ink jet head 100. The ink jet head 100 is adapted to receive ink from an ink reservoir 170 which is in fluid communications with the inlet orifices 140, and eject droplets of the ink onto a receiver (not shown) to form an image as will be described.

Figure 3:
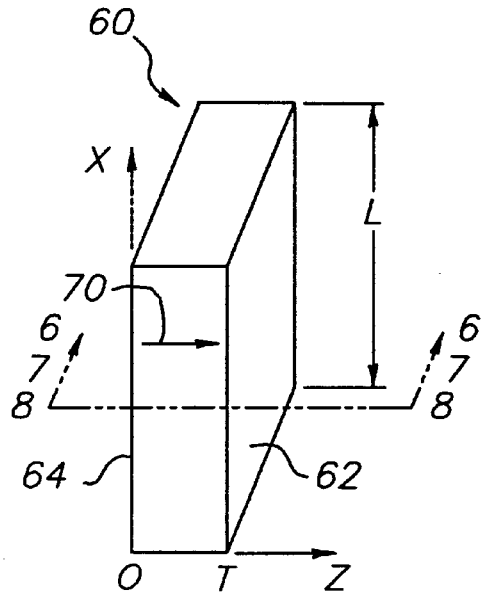
FIG. 3 is a perspective view of a slab of piezoelectric material with a functionally gradient $d_{31}$ coefficient.
Figure 4:
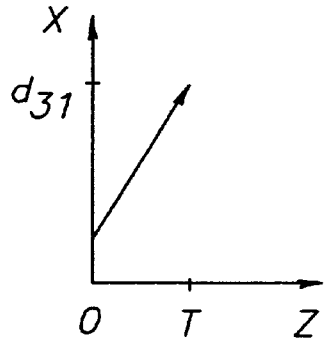
FIG. 4 is a plot of the piezoelectric $d_{31}$ coefficient across the width (T) of the slab of piezoelectric material of FIG. 3.
Figure 5:
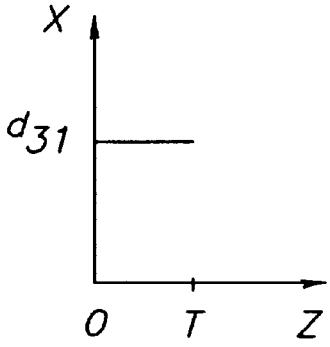
FIG. 5 is a plot of piezoelectric $d_{31}$ coefficient across the width (T) of a conventional piezoelectric bimorph transducer element, respectively.

Referring to FIGS. 3, 4 and 5, a perspective view is shown of the slab of piezoelectric material 60 with a functionally gradient $d_{31}$ coefficient. Slab of piezoelectric material 60 has first and second surfaces 62 and 64, respectively. The width of the slab of piezoelectric material 60 is denoted by T and runs perpendicular to the first and second surfaces 62 and 64, respectively, as shown. The length of the slab of piezoelectric material 60 is denoted by L and runs parallel to the first and second surfaces 62 and 64, respectively, as shown. Slab of piezoelectric material 60 is poled perpendicularly to the first and second surfaces 62 and 64 as indicated by polarization vector 70.

Skilled artisans will appreciate that in conventional piezoelectric transducers the piezoelectric "d"-coefficients are constant throughout the slab of piezoelectric material 60. Moreover, the magnitude of the induced sheer and strain are related to these "d"-coefficients via the constitutive relation as is well known. However, slab of piezoelectric material 60 used in the pumping apparatus 100 of the invention is fabricated in a novel manner so that its piezoelectric properties vary in a prescribed fashion across its width as described below. The $d_{31}$ coefficient varies along a first direction perpendicular to the first surface 62 and the second surface 64, and decreases from the first surface 62 to the second surface 64, as shown in FIG. 4. This is in contrast to the uniform or constant spatial dependency of the $d_{31}$ coefficient in conventional piezoelectric elements, illustrated in FIG. 5.

In order to form the preferred slab of piezoelectric material 60 having a piezoelectric $d_{31}$ coefficient that varies in this fashion, the following method may be used. A piezoelectric block is coated with a first layer of piezoelectric material with a different composition than the block onto a surface of the block. Sequential coatings of one or more layers of piezoelectric material are then formed on the first layer and subsequent layers with different compositions of piezoelectric material. In this way, the piezoelectric element is formed which has a functionally gradient composition which varies along the width of the piezoelectric element, as shown in FIG. 4.

Preferably, the piezoelectric materials used for forming the piezoelectric element is selected from the group consisting of PZT, PLZT, LiNbO3, LiTaO3, KNbO3 or BaTiO3. Most preferred in this group is PZT. For a more detailed description of the method, see cross-referenced commonly assigned U.S. Pat. No. 5,900,274 issued May 04, 1999, to Chattejee et al.; U.S. Ser. No. 09/071,486, filed May 01, 1998, to Furlani et al. (now abandoned); and, U.S. Pat. No. 6,013,311 issued Jan. 11, 2000, to Chatterjee, et al., hereby incorporated herein by reference.

Figure 6:
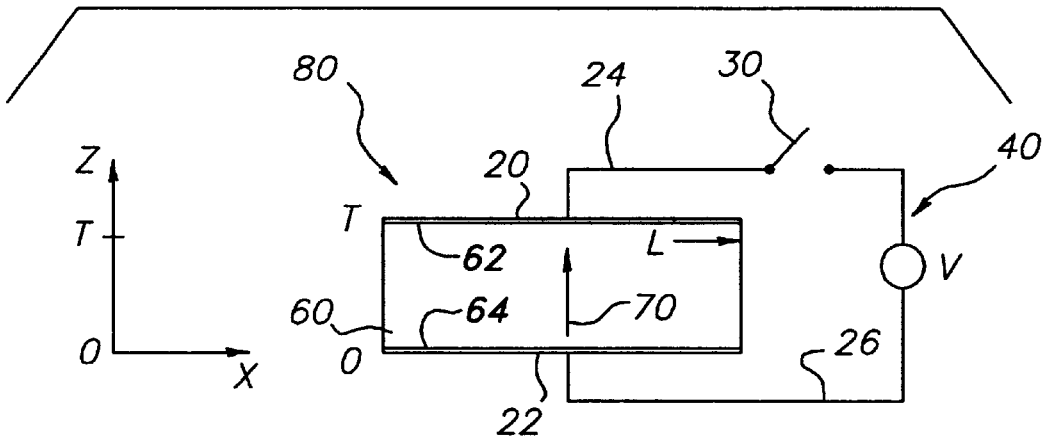
FIG. 6 is a section view along line 6—6 of FIG. 3 illustrating the piezoelectric transducer before activation.
Figure 7:
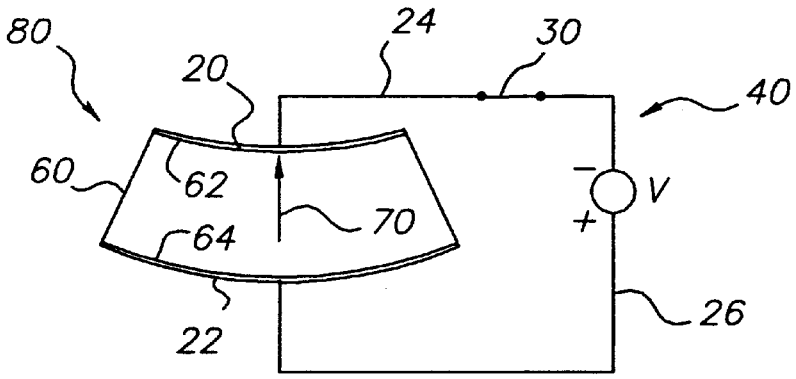
FIG. 7 is a section view taken along line 7—7 of FIG. 3 illustrating the piezoelectric transducer after activation.
Figure 8:
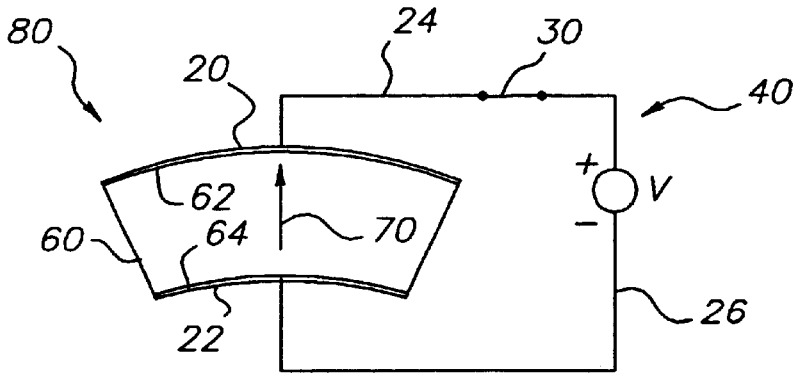
FIG. 8 is a section view taken along line 8—8 of FIG. 3 illustrating the piezoelectric transducer after activation but under a opposite polarity compared to FIG. 7.

Referring now to FIGS. 6–8, the piezoelectric transducer 80 is illustrated comprising slab of piezoelectric material 60 in the inactivated state, a first bending state and a second bending state, respectively. Piezoelectric transducer 80 comprises slab of piezoelectric material 60, with polarization vector 70, and first and second surface electrodes 20 and 22 attached to first and second surfaces 62 and 64, respectively. First and second surface electrodes 62 and 64 are connected to wires 24 and 26, respectively. Wire 24 is connected to a switch 30 that, in turn, is connected to a first terminal of voltage sour connected to the second terminal of voltage source 40 as shown.

According to FIG. 6, the transducer 80 is shown with switch 30 open. Thus there is no voltage across the transducer 80 and it remains unactivated.

Referring to FIG. 7, the transducer 80 is shown with switch 30 closed. In this case, the voltage (V) of voltage source 40 is impressed across the transducer 80 with the negative and positive terminals of the voltage source 40 electrically connected to the first and second surface electrodes 20 and 22, respectively. Thus, the first surface electrode 20 is at a lower voltage than the second surface electrode 22. This potential difference creates an electric field through the slab of piezoelectric material 60 causing it to contract in length parallel to its first and second surfaces 62 and 64, respectively and perpendicular to polarization vector 70. Specifically the change in length (in this case contraction) is given by $S(z)=-(d_{31}(z)\ V/T)\times L$ as is well known. Since the functional dependence of the piezoelectric coefficient $d_{31}(z)$ increases with z as shown in FIG. 4, the lateral contraction S(z) of the slab of piezoelectric material 60 decreases in magnitude from the first surface 62 to the second surface 64. Therefore, when the first surface electrode 20 is at a lower voltage than the second surface electrode 22, the slab of piezoelectric material 60 distorts into a first bending state as shown. It is important to note that the piezoelectric transducer 80 requires only one slab of piezoelectric material 60 as compared to two or more elements for the prior art bimorph transducer (not shown).

According to FIG. 8, the transducer 80 is shown with switch 30 closed. In this case, the voltage V of voltage source 40 is impressed across the transducer 80 with positive and negative terminals of the voltage source 40 electrically connected to the first and second surface electrodes 20 and 22, respectively. Thus, the first surface electrode 20 is at a higher voltage than the second surface electrode 22. This potential difference creates an electric field through the slab of piezoelectric material 60 causing it to expand in length parallel to its first and second surfaces 62 and 64, respectively and perpendicular to polarization vector 70. Specifically, we define S(z) to be the change in length (in this case expansion) in the x (parallel or lateral) direction noting that this expansion varies as a function of z. The thickness of the piezoelectric element is given by T as shown, and therefore $S(z)=(d_{31}(z)\ V/T)\times L$ as is well known. The functional dependence of the piezoelectric coefficient $d_{31}(z)$ increases with z as shown in FIG. 4. Thus, the lateral expansion S(z) of the slab of piezoelectric material 60 decreases in magnitude from the first surface 62 to the second surface 64. Therefore, when the first surface electrode 20 is at a higher potential than the second surface electrode 22, the slab of piezoelectric material 60 distorts into a second bending state as shown.

Referring to FIG. 9 a perspective is shown of one of the contiguous array of ink jet elements 200 of the invention. The ink jet element 200 comprises a body 110, a base 120, and a piezoelectric actuator 132. The base 120 and piezoelectric actuator 132 are fixedly attached to the body 110 as shown, thereby forming an ink storage chamber 220 which is shown in a partial cutaway view. The body 110 comprises an inlet orifice 140 (shown clearly in FIG. 2) and outlet orifice 150. According to the invention, piezoelectric actuator 132 comprises a slab of piezoelectric material 60 with first and second opposing surfaces 62 and 64. A first surface electrode 20 is mounted on the first surface 62 of slab 60 and a second surface electrode 22 is mounted on the second surface 64 of slab 60. A power source 240 has first and second terminals 250, 260 that are connected to the first and second surface electrodes 20 and 22, respectively. An ink reservoir 170 is connected via fluid conduit 180 to inlet orifice 140 for supplying fluid, for example ink, to the fluid containment chamber 220 of the micro-orifice manifold or ink jet element 200. In application, a receiver 300 may be positioned in front of the outlet orifice 150 for receiving ink drops ejected from the manifold or ink jet element 200 as will be described.

Figure 10A:
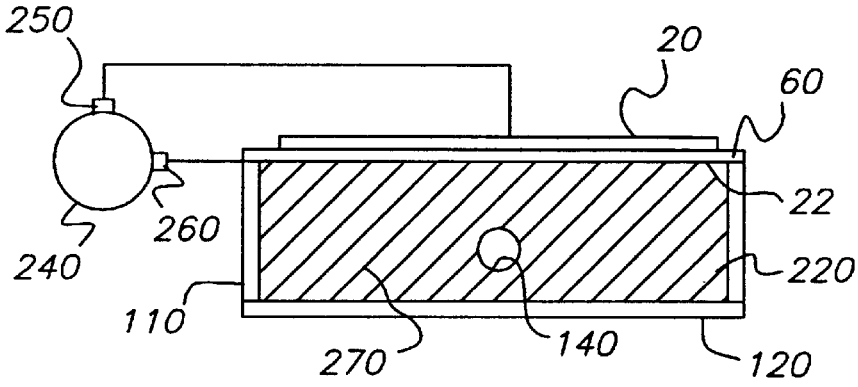
FIGS. 10A, l0B and 10C are section views of an ink jet element taken along line 10—10 of FIG. 9 showing the ink jet element in an inactivated, drop ejection, and ink refill state, respectively; and, FIGS. 11A, 11B and 11 are section views of an ink jet element taken along line 11A—11A, 11B—11B, 11C—11C, respectively, of FIG. 9 showing the ink jet element in an inactivated state, drop ejection state, and ink refill state, respectively.
Figure 10B:
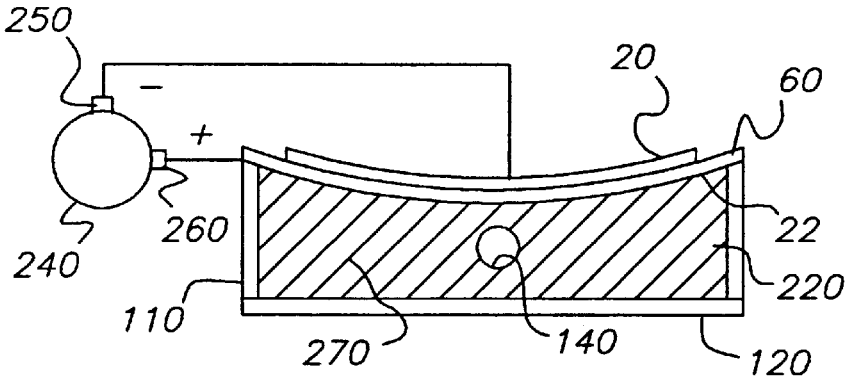
Figure 10C:
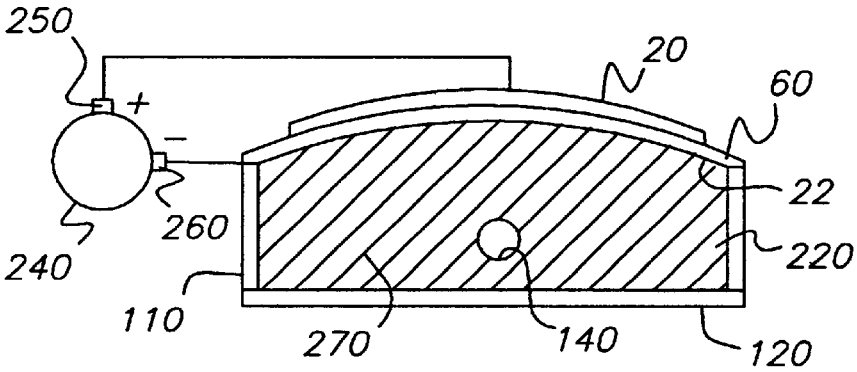
Figure 11A:
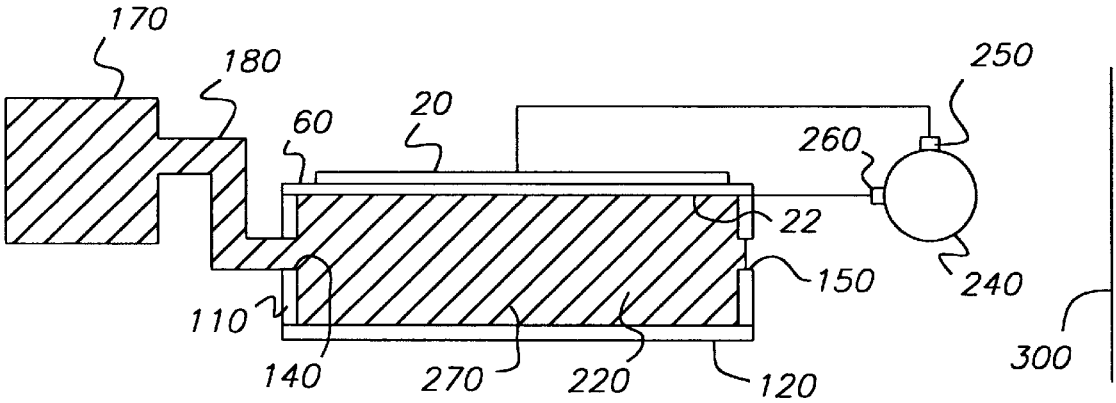
Figure 11B:
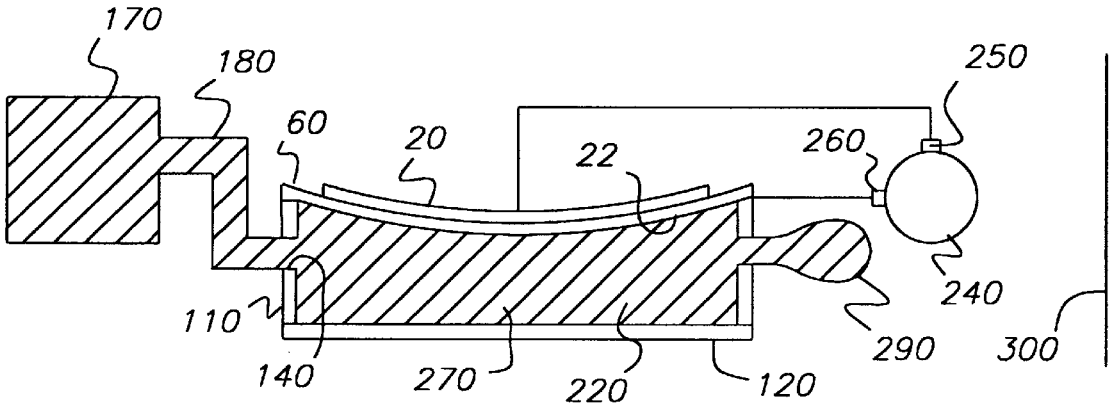
Figure 11C:
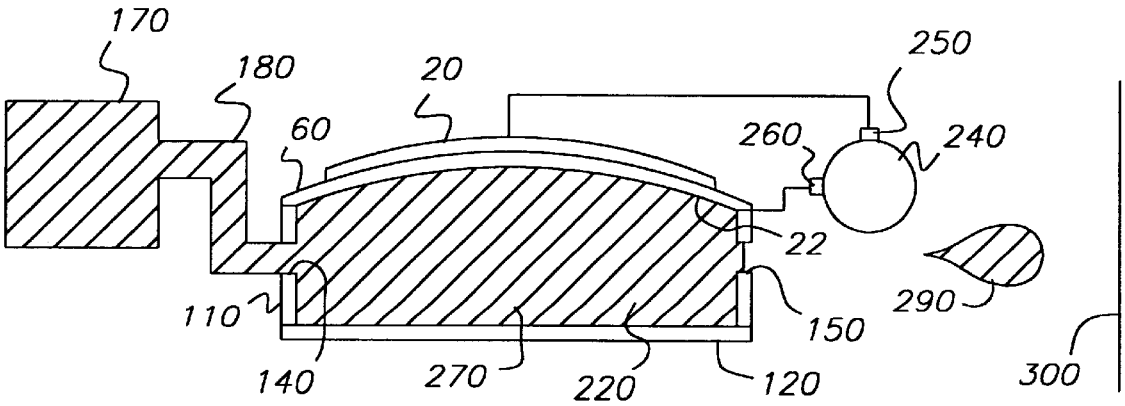

Referring now to FIGS. 10A, 10B, and 10C, and FIGS. 11A, 11B, and 11C section views are shown of ink jet element 200 taken along lines 10—10 and 11—11 of FIG. 9, respectively. The ink in the ink storage chamber 220 is indicated by the slanted lines 270. FIGS. 10A and 11A show the ink jet element 200 in an unactivated state. FIGS. 10B and 11B show the ink jet element 200 during ink drop formation and ejection, and FIGS. 10C and 11C show the ink jet element 200 during the ink refill stage.

Referring to FIGS. 10A and 11A, when the power source 240 is off, no voltage is applied to the first or second terminals 250 and 260, and therefore there is no potential difference between the first and second surface electrodes 20 and 22 and the ink jet element 200 is inactive.

Referring to FIGS. 10B and 11B, to pump a drop of ink out of the ink storage chamber 220 through the outlet orifice 150, the power source 240 provides a negative voltage to first terminal 250 and a positive voltage to second terminal 260. Thus, the first surface electrode 20 is at a lower voltage than the second surface electrode 22. This creates an electric field through the slab of piezoelectric material 60 causing it to contract in length parallel to the first and second surface electrodes 20 and 22, as discussed above. Since the functional dependence of the piezoelectric coefficient $d_{3l}(z)$ increases with (z) as shown in FIG. 4, the lateral contraction of the slab of piezoelectric material 60 decreases in magnitude from the first surface electrode 20 to the second surface electrode 22, thereby causing the slab of piezoelectric material 60 to deform into a first bending state as shown in FIG. 7. This, in turn, decreases the free volume of the ink storage chamber 220 thereby increasing the pressure to such a level that a drop of ink 290 is ejected out through outlet orifice 150 and ultimately onto a receiver 300.

Referring to FIGS. 10C and 11C, to draw ink into the ink storage chamber 220 from the ink reservoir 170, the power source 240 provides a positive voltage to terminal 250 and a negative voltage to terminal 260. Thus, the first surface electrode 20 is at a higher voltage than the second surface electrode 22. This potential difference creates an electric field through the slab of piezoelectric material 60 causing it to expand in length parallel to the first and second surface electrodes 20 and 22 as discussed above. Since the functional dependence of the piezoelectric coefficient $d_{31}$ (z) increases with (z) as shown in FIG. 4, the lateral expansion of the slab of piezoelectric material 60 decreases in magnitude from the first surface electrode 20 to the second surface electrode 22, thereby causing the slab of piezoelectric material 60 to deform into a second bending state as shown in FIG. 8. This, in turn, increases the free volume of the ink storage chamber 220 thereby decreasing the pressure in the ink storage chamber 120 so that it is less than in the reservoir 170. Under this condition ink flows form the reservoir 170 via the conduit 180, through the inlet orifice 140 into the ink storage chamber 220.

The operation of the ink jet head 100 can now be understood via reference to FIGS. 1, 2, 9, 10, and 11. To eject a drop of ink out of one of the plurality of ink storage chambers 220, the power source 160 simultaneously imparts a voltage to the first surface electrode 20 that is operably associated with the respective ink storage chamber 220, and a different voltage to the second surface electrode 22 such that the respective first surface electrode 20 is at a lower voltage than the second surface electrode 22. This creates an electric field through a portion of the slab of piezoelectric material 60 between the respective first surface electrode 20 and the second surface electrode 22 thereby causing it to contract in length parallel to the respective first surface electrode 20 and second surface electrode 22, as discussed above. Since the functional dependence of the piezoelectric coefficient $d_{3l}$ (z) increases with (z) as shown in FIG. 4, the lateral contraction of the portion of the slab of piezoelectric material 60 between the respective first surface electrode 20 and the second surface electrode 22 decreases in magnitude from the respective first surface electrode 20 to the second electrode 22, thereby causing the portion of the slab of piezoelectric material 60 between the respective first surface electrode 20 and the second surface electrode 22 to deform into a first bending state as shown in FIG. 7. This, in turn, decreases the free volume of the respective ink storage chamber 220 thereby increasing the pressure of the ink in the respective ink storage chamber 220 to such a level that a drop of ink 290 is ejected out through outlet orifice 150 of the respective ink storage chamber 220 and ultimately onto a receiver 300.

To draw ink into one of the plurality of the ink storage chambers 220 of the ink jet head 100 from the ink reservoir 170, the power source 160 simultaneously imparts a voltage to the of first surface electrode 20 that is operably associated with the specified ink storage chamber 220 and a different voltage to the second surface electrod 22 such that the respective first surface electrode 20 is at a higher voltage than the second surface electrode 22. This creates an electric field through a portion of the slab 60 between the respective first surface electrode 20 and the second surface electrode 22 thereby causing slab 60 to expand in length parallel to the respective first surface electrode 20 and second surface electrode 22, as discussed above. Since the functional dependence of the piezoelectric coefficient $d_{31}$ (z) increases with (z) as shown in FIG. 4, the lateral expansion of the portion of the slab of piezoelectric material 60 between the respective first surface electrode 20 and the second surface electrode 22 increases in magnitude from the respective first surface electrode 20 to the second surface electrode 22, thereby causing the portion of the slab of piezoelectric material 60 between the respective first surface electrode 20 and the second surface electrode 22 to deform into a second bending state as shown in FIG. 7. This, in turn, increases the free volume of the respective ink storage chamber 220 thereby decreasing the pressure in the respective ink storage chamber 220 so that it is less than in the ink reservoir 170. Under this condition ink flows from the ink reservoir 170 via the conduit 180, through the inlet orifice 140 into the respective ink storage chamber 220.

Therefore, the invention has been described with reference to a preferred embodiment. However, it will be appreciated that variations and modifications can be effected by a person of ordinary skill in the art without departing from the spirit and scope of the invention.

PARTS LIST

| | |
|---|---|
| 20 | first surface electrode |
| 22 | second surface electrode |
| 24 | wire |
| 26 | wire |
| 30 | switch |
| 40 | voltage source |
| 60 | slab of piezoelectric material |
| 62 | first surface |
| 64 | second surface |
| 70 | polarization vector |
| 80 | piezoelectric transducer |
| 100 | piezoelectric ink jet head |
| 110 | body |
| 120 | base |
| 130 | piezoelectric actuating element |
| 132 | piezoelectric actuator |
| 140 | inlet orifice |
| 150 | outlet orifice |
| 156 | first terminal |
| 158 | second terminal |
| 160 | power source |
| 162 | wires |
| 164 | wire |
| 170 | reservoir |
| 180 | conduit |
| 200 | ink jet element |
| 220 | ink storage chamber |
| 240 | power source |
| 250 | first terminal |
| 260 | second terminal |

What is claimed is:

1. A method of directing fluid flow between a reservoir and a micro-fluidic manifold having a plurality of independent fluid containment chambers, said method including the steps of:

(a) providing a piezoelectric actuator element in structural relations with each one of said fluid containment chamber, said piezoelectric actuator element having a substantially planar piezoelectric transducer comprising a slab of piezoelectric material having a first surface and an opposing second surface, a plurality of spatially separated first electrodes arranged on said first surface, wherein each one of said plurality of first electrodes is operably associated with one of said independent ink compartments, and a second electrode extending substantially lengthwise along the opposed second surface, said piezoelectric material having a functionally gradient d-coefficient formed by three or more sequential layers of different compositions of piezoelectric material, each one of said sequential layers having different d-coefficients defining a functionally gradient d-coefficient throughout said slab and selected so that said slab changes geometry in response to an applied voltage which produces an electric field in the slab; and said plurality of first electrodes and said second electrode being arranged so that voltage applied to any one of said plurality of first electrodes and said second electrode induces an electric field in a portion of said slab between said any one of said plurality of first electrodes and said second electrode;

(b) providing a source of power operably associated with each one of said plurality of first electrodes and to said second electrode of said piezoelectric transducer for enabling fluid flow through any one of said plurality of fluid containment chambers; and (c) actuating said piezoelectric transducer for pumping fluid from any one of said independent ink compartments through said manifold.

2. The method recited in claim 1 wherein the step of actuating said piezoelectric transducer includes the steps of selectively applying a voltage to one of said plurality of first electrodes and simultaneously applying a different voltage to said second electrode, the voltage applied to the one of said first electrodes being somewhat lower than the voltage applied to said second electrode.

3. The method recited in claim 2 wherein the step of actuating further includes alternatively the steps of selectively applying a voltage to the one of said plurality of first electrodes and simultaneously applying a different voltage to said second electrode, the voltage applied to the one of said first electrode being somewhat higher than the voltage applied to said second electrode.

4. The method recited in claim 1 wherein the step of providing a piezoelectric actuator further includes the step of providing said piezoelectric material selected from the group consisting of PZT, PLZT, $LiNbO_3$, $KnbO_3$, $BaTiO_3$ and a mixture thereof.

5. The method recited in claim 1 wherein said step of providing said piezoelectric actuator further includes the step of providing parallel first and second surfaces of said slab and poling said slab in a direction perpendicular to the first and second surfaces.

* * * * *